United States Patent [19]

Grant

[11] 3,966,190

[45] June 29, 1976

[54] SHEET ADVANCING METHODS AND APPARATUS

[75] Inventor: Frederic F. Grant, Bellflower, Calif.

[73] Assignee: Bell & Howell Company, Chicago, Ill.

[22] Filed: Nov. 30, 1973

[21] Appl. No.: 420,737

[52] U.S. Cl. ..... 271/42; 271/119; 271/128

[51] Int. Cl.[2] ..... B65H 3/02

[58] Field of Search ..... 271/42, 128, 130, 119

[56] References Cited

UNITED STATES PATENTS

| | | | |
|---|---|---|---|
| 2,379,361 | 6/1945 | LaBombard | 271/119 X |
| 2,713,486 | 7/1955 | Aydlett | 271/42 |
| 3,008,606 | 11/1961 | Limberger | 271/119 X |
| 3,051,478 | 8/1962 | Rasmusson | 271/42 |
| 3,195,886 | 7/1965 | Houver | 271/42 |
| 3,260,402 | 7/1966 | Lareau et al. | 271/42 X |

*Primary Examiner*—John J. Love
*Assistant Examiner*—Bruce H. Stoner, Jr.
*Attorney, Agent, or Firm*—Benoit Law Corporation

[57] ABSTRACT

In order to advance a sheet-like piece of material, low-friction and high-friction members are provided. These low-friction and high-friction members jointly form a continuous cylindrical surface. The piece is first contacted with the material having the low friction, and is subsequently engaged with the material having the high friction. The piece is then advanced by advancing the material having the high friction.

1 Claim, 6 Drawing Figures

SHEET ADVANCING METHODS AND APPARATUS

CROSS - REFERENCES

The following United States patents and/or copending patent applications, filed of even date, disclose or disclose and claim subject matter which is shown herein and/or which may be employed in the practice of the subject invention. These patents or applications are assigned to the same assignee as the subject patent application or patent and are herewith incorporated by reference herein.

Ser. No. 420,503, now abandoned entitled Communication Methods and Billing Systems, by R. A. Boyle, E. S. Gilchrist and R. L. Visser;

Ser. No. 420,734, entitled Communication Methods and Billing Systems, by E. S. Gilchrist and R. L. Visser;

Ser. No. 420,735, now U.S. Pat. No. 3,897,944, and Apparatus for Performing a Function Relative to a Card, by F. F. Grant;

Ser. No. 420,736, now abandoned entitled Printing Apparatus by E. S. Gilchrist and F. F. Grant;

Ser. No. 420738, now U.S. Pat. No. 3,900,191, entitled Card Advancing and Function Performing Methods and Apparatus, by D. W. Westover and F. F. Grant;

Ser. No. 420,739, now U.S. Pat. No. 3,915,086 entitled Printing Methodsand Apparatus, by R. M. McManaman; and Ser. No. 420740, now abandoned entitled Character Expressing and Printing Methods and Apparatus, by E. S. Gilchrist and A. B. Nayak.

BACKGROUND OF THE INVENTION

1. Field of the Invention

The subject invention relates to apparatus and methods for advancing pieces of material and methods and apparatus for removing one sheet at a time from a stack of sheets of material.

2. Description of the Prior Art

The many existing proposals, techniques and apparatus for advancing pieces of material and/or for removing one sheet at a time from a stack of sheets of material, have still left an unsatisfied need for methods of this kind which are simple, inexpensively practised, and yet highly reliable, and a need for apparatus of this type which are relatively simple and inexpensive, but highly reliable in their operation.

SUMMARY OF THE INVENTION

It is an object of this invention to fill the above mentioned needs.

It is an object of this invention to provide improved methods and apparatus for advancing pieces of material.

It is an object of this invention to provide improved methods and apparatus for removing one sheet at a time from a stock of sheets of material.

Related or other objects will become apparent from the further course of this disclosure.

From one aspect thereof, the invention resides in a method of advancing a piece of material and resides, more specifically, in the improvement comprising in combination the steps of providing material having a first friction relative to said piece, providing material having a second friction relative to said piece, said second friction being higher than said first friction, forming a continuous cylindrical surface with said materials having said first and second frictions, contacting said piece first with the material having said first friction, and subsequently engaging said piece with the material having said second friction and advancing said piece by advancing the material having said second friction.

From another aspect thereof, the invention resides in a method of at least partially removing one sheet at a time from a stack of sheets of material, and resides, more specifically, in the improvement comprising in combination the steps of forming a continuous cylindrical surface with a member having a first friction and a member having a second friction, inserting said stack between a support and said member having a first friction, securing the sheets in said stack below the top sheet of said stack against movement in at least one direction, engaging said top sheet of the stack with said member having a second friction higher than said first friction, and at least partially removing said top sheet from said stack by moving said engaged second friction member in said one direction.

From another aspect thereof, the invention resides in apparatus for advancing a piece of material, and resides, more specifically, in the improvement comprising, in combination, means for supporting said piece of material, a device including a first portion having a first friction relative to said piece and a second portion having a second friction relative to said piece, said second friction being higher than said first friction and said first and second portions jointly forming a continuous cylindrical surface means connected to said device for moving said second portion into engagement with said piece and for moving said piece with said engaged second portion relative to said support, and for alternatively moving said first portion into contact with said piece and said second portion out of engagement with said piece.

From yet another aspect thereof, the invention resides in apparatus for advancing a piece of material, and resides, more specifically, in the improvement comprising, in combination, means for supporting said piece of material, a device including a first portion having a first friction relative to said piece and a second portion having a second friction relative to said piece, said second friction being higher than said first friction and said first and second portions jointly forming a continuous cylindrical surface, means for mounting said device for movement of said first portion into contact with said piece in response to a first relative movement between said device and said piece, and for movement of said second portion into engagement with said piece in response to a second relative movement between said device and said piece, and means for relatively moving said device and said piece in the sense of said first relative movement and alternatively in the sense of said second relative movement.

From still another aspect thereof, the invention resides in apparatus for advancing pieces of material and, more specifically, in the improvement for removing the top piece of material from a stack of said pieces of material, comprising in combination, means for resiliently mounting said stack, means adjacent said resilient mounting means for forming an opening for the passage of only the top piece of material from said stack, a rotary device for selectively advancing said top piece of material through said opening, said rotary device having a flat surface extending in parallel to an axis of rotation of said rotary device, and a circumferential continuous cylindrical surface, and said rotary device including at said cylindrical surfacce a first portion having a first friction relative to said top piece, and a second portion having a second friction relative to said top piece, said second friction being higher than said first friction, means connected to said device for moving said second portion into engagement with said top piece and for moving said top piece with said engaged second portion relative to the remaining pieces in said stack and through said passage opening, and for alternatively moving said first portion into contact with said top piece and said second portion out of engagement with said top piece, and for moving said rotary device along a top piece of said stack in a direction contrary to the direction of movement of said top piece with said engaged second portion, and means adjacent said flat surfacce of said rotary device for stopping with the aid of a first part of said rotary device at said flat portion the rotation of said rotary device when said second portion has been moved into engagement with said top piece, and for stopping with the aid of a second part of said rotary device at said flat portion the rotation of said rotary device when said first portion has been moved into contact with said top piece.

The expression "sheet" as herein employed is not intended to be limited to bodies fitting the everyday meaning of that term, but is intended to include cards and other materials of a sheet-like configuration.

The methods and apparatus herein disclosed have utility of their own, as they may be employed in various applications and equipment wherein pieces of material are to be advanced and/or wherein one sheet at a time is to be removed from a stack of sheets of material.

By way of example, and not by way of limitation, the subject invention has utility in applications and in equipment where cards or sheets are fed serially to and/or from a printing station. By way of further example, the subject invention has utility in data reading equipment, wherein cards, checks or other records are successively fed to a reading station.

Other applications include counting systems in which cards or other pieces of material are serially advanced in order to be counted.

BRIEF DESCRIPTION OF THE DRAWINGS

The invention will become more readily apparent from the following detailed description of preferred embodiments thereof, illustrated by way of example in the accompanying drawings, in which.

DESCRIPTION OF PREFERRED EMBODIMENTS

Figure 1:
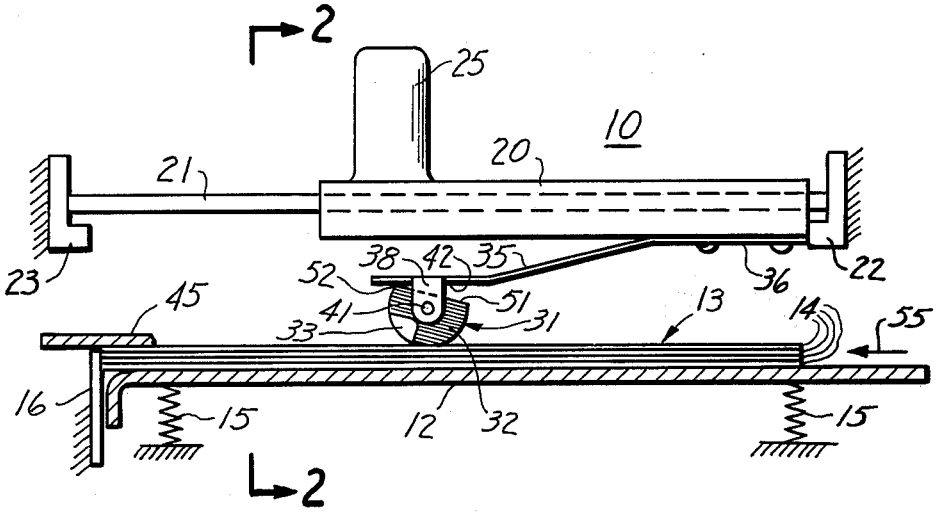
FIG. 1 is a side view of a card advancing apparatus in accordance with a preferred embodiment of the subject invention.
Figure 2:
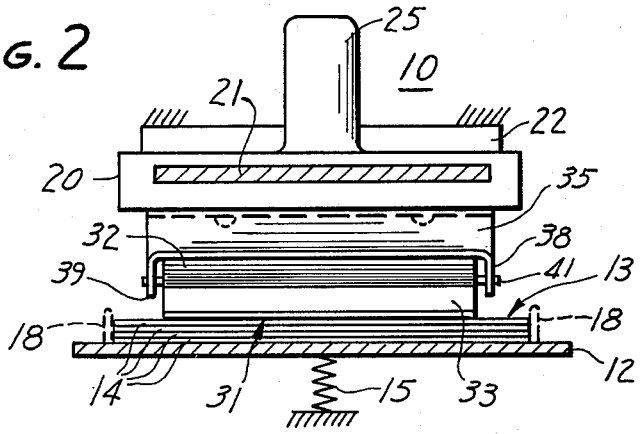
FIG. 2 is a section taken along the line 2 — 2 in FIG. 1.

The card advancing apparatus 10 shown in FIGS. 1, 2, 3 and 4 has a plate 12 for supporting a stack 13 of cards 14. The supporting plate 12 is resiliently mounted by spring devices schematically shown at 15 in FIGS. 1 and 2 only.

A relatively stationary upright member or ledge 16 secures the cards 14 in the stack below the top card against movement in the direction of the arrow 17 shown in FIG. 3. Where lateral movement of the cards 14 is a problem, lateral card guides or restraining members shown in dotted outlines at 18 in FIG. 2 may be provided.

Figure 4:
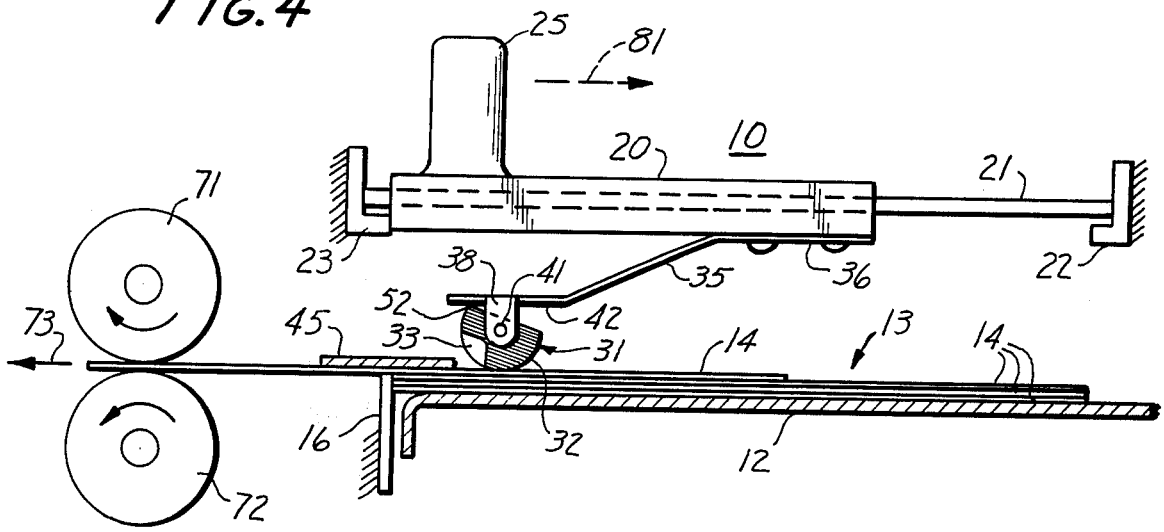
FIG. 4 is a view similar to FIG. 1 showing a second phase of operation of the apparatus of FIG. 1.

The card advancing apparatus 10 further includes a carriage 20 which travels along a track 21 from an initial position at a stop 22 (see FIG. 1) to an advanced position at a stop 23 (see FIG. 4). A handle or actuating member 25 is connected to the carriage 20 to permit manual or other actuation thereof between the stops 22 and 23.

The heart of the apparatus shown in FIGS. 1 to 4 is a device 31 which has a first portion 32 having a first friction relative to the cards 14, and a second portion 33 having a second friction relative to the cards 14. The second friction is higher than the first friction, so that the first portion 32 may be referred to as a low-friction portion, while the second portion 33 may be referred to as a high-friction portion.

The portion 32 may be formed of a metal or plastic material having a low friction relative to the portion 33. By way of example, the portion 33 was made of polished nylon in a prototype of the subject invention. On the other hand, a typical high-friction material, such as rubber or a high-friction elastomer may be employed for the portion 33. In the illustrated preferred embodiment, the portion 33 is provided as an insert in the portion 32.

As seen in FIGS. 1 to 4, the illustrated preferred card advancing device 31 is in the form of a rotary body having the portions 32 and 33 at peripheral regions thereof, with said portions 32 and 33 jointly forming a continuous cylindrical surface.

The card advancing device 31 is mounted on a cantilever spring 35 which is attached to the carriage 20 at 36. The cantilever spring 35 has downwardly projecting ears 38 and 39 which retain a shaft 41 in spaced relationship to an adjacent portion 42 of the spring.

A plate 45 extends over the potentially leading edges of the cards 14 at a distance corresponding to the thickness of a card relative to the upper edge of the ledge 16, so that only the top card in the stack 13 at any time can clear the ledge 16. The plate 45 may extend over the lateral edges of the cards adjacent the sides of the card advancing device 31 and also over the potentially trailing edges of the cards, all to the effect of limiting upward movement of the card stack 13.

Figure 3:
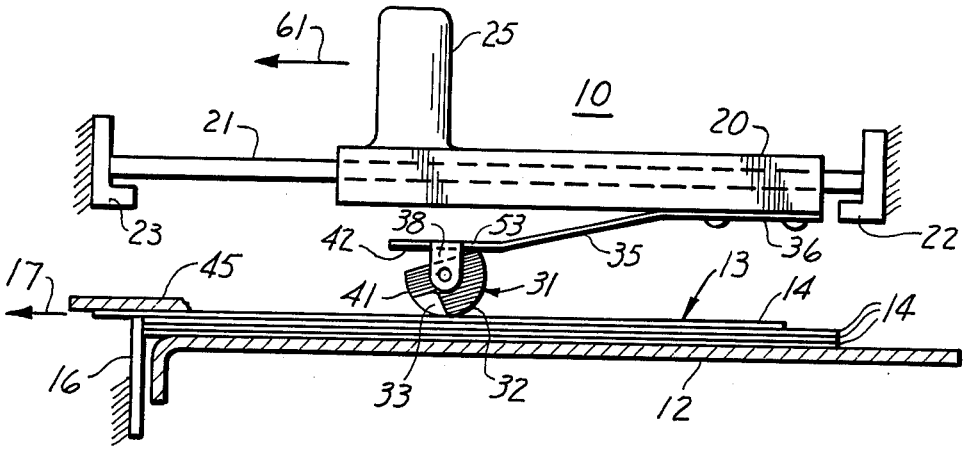
FIG. 3 is a view similar to FIG. 1 showing a first phase of operation of the apparatus of FIG. 1.

The rotary body 31 shown in FIGS. 1 to 4 has a flat top 51 located above the cylindrical body portion. The flat top 51 together with the cylindrical portion of the body 32 forms a first stop 52 which in FIGS. 1 and 4 is seen in engagement with the cantilever spring 35, and a second stop 53 which in FIG. 3 is seen in engagement with the spring 35.

The stops 52 and 53 limit rotary movement of the card advancing device in a first sense and alternatively in a second sense.

The full stack 13 of cards 14 may initially be inserted in the direction of the arrow 55 shown in FIG. 1 in between the support and platform 12 and the card advancing device 31, and against the ledge 16. This rotates, the card advancing device 31 clockwise as seen in FIG. 1 until the stop 52 engages the spring 53 and thereby inhibits further rotary movement of the device 31 at that time.

In this manner, the low-friction portion 32 of the device 31 is brought into contact with the top card on the stack 13. The device 31 therefore does not resist insertion of the card stack 13 into the apparatus 10.

The carriage 20 may then be moved in the direction of the arrow 61 shown in FIG. 3 by appropriate actuation of the handle 25. This immediately causes the cylindrical device 31 to roll relative to the card stack so as to move the high-friction portion 33 into engagement with the top card on the stack 13. The stop 53 inhibits further rotation of the device as soon as the top card has been sufficiently engaged by the high-friction portion 33.

Further advancement of the carriage 20 in the direction of the arrow 61 will cause the high-friction portion 33 of the card advancing device 31 to move the top card of the stack by frictional engagement in the direction of the arrow 17 shown in FIG. 3.

Since the top card clears the ledge 16 as hereinbefore described, this top card is thus partially removed from the remainder of the stack 13 as the carriage is moved further toward and eventually into engagement with the stop 23 as shown in FIG. 4.

In principle, it would be possible to remove the top card completely from the stack 13 by means of the device 31. However, FIG. 4 illustrates a preferred embodiment of the invention according to which the partially removed top card 14 is removed by a further device. By way of example, a pair of counterrotating rollers 71 and 72 is shown in FIG. 4 as a means for removing an advanced top card. In particular, the card advancing device 31 advances the leading edge of the top card in between the rollers 31 and 32, whereby these rotating rollers grab the top card, advance it in the direction of the arrow 73 shown in FIG. 4, and remove it entirely from the stack 13.

In accordance with the principles of the illustrated preferred embodiment of the invention, advancement of the top card by the rollers 71 and 72 or by another secondary card advancing device causes clockwise rotation of the primary card advancing device 31 until the stop 52 engages the spring 35 in order to inhibit further rotary movement at that time.

The counterclockwise movement of the card advancing device 31 at the beginning of the phase of operation shown in FIG. 3 has moved the low-friction portion 32 out of contact with the top card and has simultaneously moved the high-friction portion 33 into engagement with the top card. p Contrariwise, the clockwise rotation of the device 31 according to FIG. 4 moves the high-friction portion 33 out of engagement with the top card 14 and simultaneously moves the low-friction portion 32 into engagement with that top card. In consequence, the card advancing device 31 will offer very little resistance to the removal of the top card by the rollers 71 and 72.

Depending on the utilization of the subject invention, the rollers 71 and 72 or other secondary card advancing means may supply the removed top card to a card reader, a printing device, a card counter, or any other desired device. None of these has been shown in the drawing as they do not form part of the subject invention.

Upon completion of the removal of a top card, the card advancing device 31 contacts the next top card in the stack 13 with its low-friction portion 32. The carriage 20 may then be returned from its advanced position shown in FIG. 4 to its initial position shown in FIG. 1 by actuation of the handle 25 in the direction of the dotted arrow 81 shown in FIG. 4. In this manner, the card advancing device 31 slides with its low-friction portion 32 along the top of the stack 13 preparatory to a removal of the next top card in the stack.

Since the low-friction portion 32 thereby maintains the high-friction portion 33 out of engagement with the stack at that time, no backward sliding motion of the engaged top card of the stack takes place when the carriage 20 is returned to the stop 22 shown in FIG. 1.

Another top card may then be removed from the stack simply by actuating the carriage 20 in the direction of the arrow 61 shown in FIG. 3 whereby the previously described card advancing or removing operation will be effected on the newly engaged top card of the stack 13.

It will thus be appreciated that the device 31 according to the subject invention may be viewed as a unidirectional card advancing device which only advances cards in the direction of the arrow 17 (see FIG. 3), but not in the opposite direction. The device 31 has, therefore, been called a "mechanical diode".

Figure 5A:
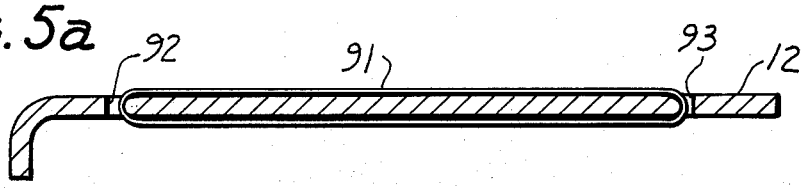
FIG. 5*a* is cross section through a card supporting plate that may be employed in the apparatus of FIG. 1.
Figure 5B:
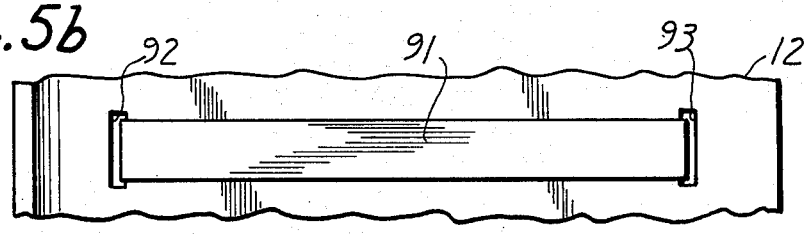
FIG. 5*b* is a top view of a fraction of the supporting plate of FIG. 5*a*.

If desired, and as shown in FIGS. 5a and b, the card support or platform 12 may be equipped with one or more endless belts 91 which extend through slots 92 and 93 in the support 12. In certain applications, these belts 91 facilitate a removal of the last card in the stack and an unimpeded return of the card advancing device 31 to its initial position shown in FIG. 1. In a prototype of the illustrated preferred embodiment, the belts 91 have been made of mylar, but other tough and wear-resistant material may obviously be employed.

The subject detailed disclosure will suggest various modifications and variations within the spirit and scope of the subject invention to those skilled in the art.

I claim:

1. In apparatus for advancing pieces of material, the improvement for removing the top piece of material from a stack of said pieces of material, comprising in combination:

means for resiliently mounting said stack;

means adjacent said resilient mounting means for forming an opening for the passage of only the top piece of material from said stack;

a rotary device for selectively advancing said top piece of material through said opening, said rotary device having a flat surface extending in parallel to an axis of rotation of said rotary device, and a circumferential continuous cylindrical surface, and said rotary device including at said cylindrical surface a first portion having a first friction relative to said top piece, and a second portion having a second friction relative to said top piece, said second friction being higher than said first friction;

means connected to said device for moving said second portion into engagement with said top piece and for moving said top piece with said engaged second portion relative to the remaining pieces in said stack and through said passage opening, and for alternatively moving said first portion into contact with said top piece and said second portion out of engagement with said top piece and for moving said rotary device along a top piece of said stack in a direction contrary to the direction of movement of said top piece with said engaged second portion; and means adjacent said flat surface of said rotary device for stopping with the aid of a first part of said rotary device at said flat portion the rotation of said rotary device when said second portion has been moved into engagement with said top piece, and for stopping with the aid of a second part of said rotary device at said flat portion the rotation of said rotary device when said first portion has been moved into contact with said top piece.

* * * * *